United States Patent [19]

Sanders

[11] Patent Number: 5,007,359

[45] Date of Patent: Apr. 16, 1991

[54] ZIPPER STITCHING GUIDE

[76] Inventor: Mildred P. Sanders, 3 Dogwood Hill Dr., Jackson, Miss. 39211

[21] Appl. No.: 527,801

[22] Filed: May 24, 1990

[51] Int. Cl.[5] ..... D05B 35/06; D05B 3/12

[52] U.S. Cl. ..... 112/265.2; 112/152

[58] Field of Search ..... 112/136, 169, 265.1, 112/265.2, 152

[56] References Cited

U.S. PATENT DOCUMENTS

| | | | |
|---|---|---|---|
| 3,286,669 | 11/1966 | Rockerath et al. | 112/265 |
| 3,331,342 | 7/1967 | Herrmann | 112/136 |
| 3,348,509 | 10/1967 | Degraw | 112/265 |
| 3,380,173 | 4/1968 | Pasqualetti . | |
| 3,444,598 | 5/1969 | Glindmeyer et al. | 24/205.16 |
| 3,456,305 | 7/1969 | Voit | 112/265.2 |
| 3,794,554 | 2/1974 | Caring | 161/109 |
| 3,806,955 | 4/1974 | Weyrick et al. | 2/266 |
| 4,265,190 | 5/1981 | Moertel | 112/265 |
| 4,353,760 | 10/1982 | Moertel | 156/66 |
| 4,425,391 | 1/1984 | Wilson | 112/152 |
| 4,870,918 | 10/1989 | Hiramatsu et al. | 112/265.2 |

OTHER PUBLICATIONS

Exhibit A: William Prym, Inc., His/Hers Fly Front Zipper Guides, (date unknown).

Exhibit B: William Prym, Inc., Top Stitch/Zipper Guides (date unknown).

*Primary Examiner*—Werner H. Schroeder

*Assistant Examiner*—Sullivan C. Prak

*Attorney, Agent, or Firm*—John E. Benoit

[57] ABSTRACT

A stitching guide for attachment of a zipper to a base material comprising a strip of elongated material having at least one substantially straight longitudinal edge, a plurality of in-line perforations in the strip extending along a longitudinal line substantially parallel to the straight longitudinal edge, and at least one slot in the strip, the slot having a geometrical configuration adapted to circumscribe the slide on the zipper. The perforations in the strip are centrally located for pin insertion during centered zipper application and offset for pin insertion during lapped zipper application. The strip is preferably sufficiently flexible to allow pin insertion and is tinted and may have measurement indicia along the straight longitudinal edge.

13 Claims, 1 Drawing Sheet

ZIPPER STITCHING GUIDE

BACKGROUND OF THE INVENTION

This invention relates generally to sewing and more specifically to a zipper stitching guide.

The ultimate goal of a seamstress is to construct a garment which, when finished, does not appear to have been homemade. While many errors in sewing may not be obvious and can even be hidden, the stitching of the zipper is almost always visible and is the one tell-tale sign of whether a garment is purchased or homemade.

Many sewing aids to use with zippers have been on the market for a long time. After purchasing the aids and experimenting with them, however, most seamstresses return to the tried and true method of zipper installation. Zipper installation has been both improved and simplified to some degree, but the necessity of stitching a straight line or lines on top of the zipper has never changed. Assurance of a straight line requires measuring and marking on the right side of the fabric a one-fourth inch line or lines to stitch over if the garment is to look professional.

Marking the fabric is a time-consuming endeavor; the longer the zipper, the more time-consuming. The most satisfactory of marking fabrics today are the felt-tip markers which are water-soluble. Some fabrics are stained by the markers, however, necessitating testing the marker on the inside of the fabric before use.

The older method of marking fabrics with tailoring chalk is unsatisfactory because the chalk does not mark as easily or successfully as the felt-tip markers, depending on the fabric. Further, it is sometimes difficult to remove chalk marks after sewing over them.

Finally, removing the marking, while simple enough, is just one more step which must be taken when installing a zipper.

It is an object of the present invention to shorten the time required to insert a zipper by eliminating the necessity of having to measure and mark stithing lines and then removing the marking after the zipper is completed. The zipper is installed in a neat, professional manner which even a beginning seamstress can accomplish. All a seamstress must do is stitch immediately outside the guide of the present invention.

There is no guesswork involved in the present invention. There are perforations for pinning the guide to the garment for either the lapped or centered zipper application. The perforations are aligned to be pinned directly over the seam enclosing the zipper.

The zipper guide may also be used as a ruler. While rulers made specifically for sewing are available, they are made of metal and impossible to use for measuring rounded areas and curves, or, for example, the diameter of the arm hole of a garment. The present invention can be made of lightweight plastic material which is pliable and can accomplish any type of measuring—straight lines, curves, etc.

The standard seam allowance set for all patterns is $\frac{5}{8}$ inch. The width of the present invention is such that it provides a handy reference tool for seam allowances.

SUMMARY OF THE INVENTION

The present invention provides a stitching guide for attachment of a zipper to a base material comprising a strip of elongated material having at least one substantially straight longitudinal edge, a plurality of in-line perforations in the strip extending along a longitudinal line substantially parallel to the straight longitudinal edge, and at least one slot in the strip, the slot having a geometrical configuration adapted to circumscribe the slide on a zipper. The perforations in the strip are centrally located for pin insertion during centered zipper application and offset from the center of the guide for pin insertion during lapped zipper application. The strip is preferably sufficiently flexible to allow pin insertion and is tinted and may have measurement indicia along the straight longitudinal edge.

DETAILED DESCRIPTION OF THE PREFERRED EMBODIMENTS

Figure 1:
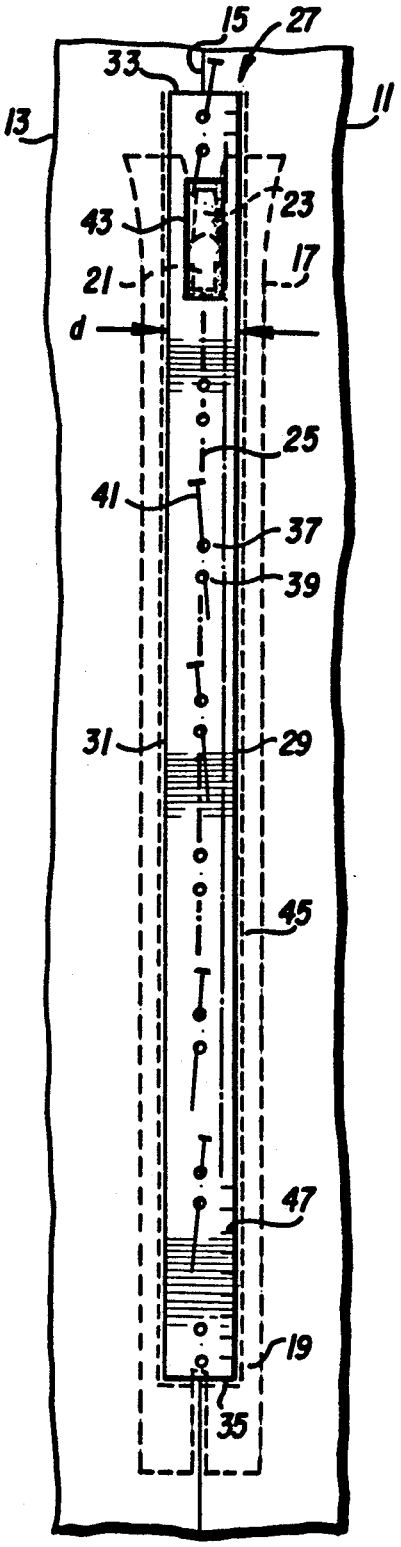
FIG. 1 is a plan view of the zipper guide in place on the material and the zipper.

FIG. 1 shows two pieces of material 11 and 13 to which a zipper has been centered under the opening edges and machine-basted. In the position shown, the material has been placed with the zipper under the material such that the dotted lines indicate zipper 17, zipper stop 19, slider 21, pull tab 23, and teeth center line 25. It is noted that center line 25 of the zipper is mated with seam line 15.

Stitching guide 27 is shown as having two substantially parallel straight line sides 29 and 31, top edge 33 and bottom edge 35. A plurality of perforations such as 37 and 39 extend in line longitudinally substantially along the longitudinal center line of stitching guide 27. The strip is sufficiently flexible so that when it is in the position as shown, pins 41 may be inserted through selected perforations so as to hold the guide in place.

In the configuration as shown in FIG. 1, slot 43 is provided in guide 27. This slot has a geometrical configuration such that it will circumscribe slider 21 and pull tab 23 so that the guide may lie substantially flat on the material. It should be further noted that the guide is of a sufficient length that the lower edge extends beyond zipper stop 19. With zipper guide 27 in the position as shown, stitching is started beginning at the edge of the top of the zipper guide, down one side thereof, across the bottom, and up the other side, which results in stitching line 45. The stitching guide may then be removed and the basted seam may be opened so as to provide the finished garment.

Since the stitching guide is flexible, it is advantageous to have measuring indicia 47 along one of the straight edges of the guide. For purposes of illustration, indicia 47 has been shown only part way along the guide, but it is to be understood that it may extend over the length of the guide.

The above description relates to a stitching guide which is used for a centered or slot application. It will be obvious that it is desirable to have the perforations substantially along the center line of the zipper guide for such an application.

Figure 2:
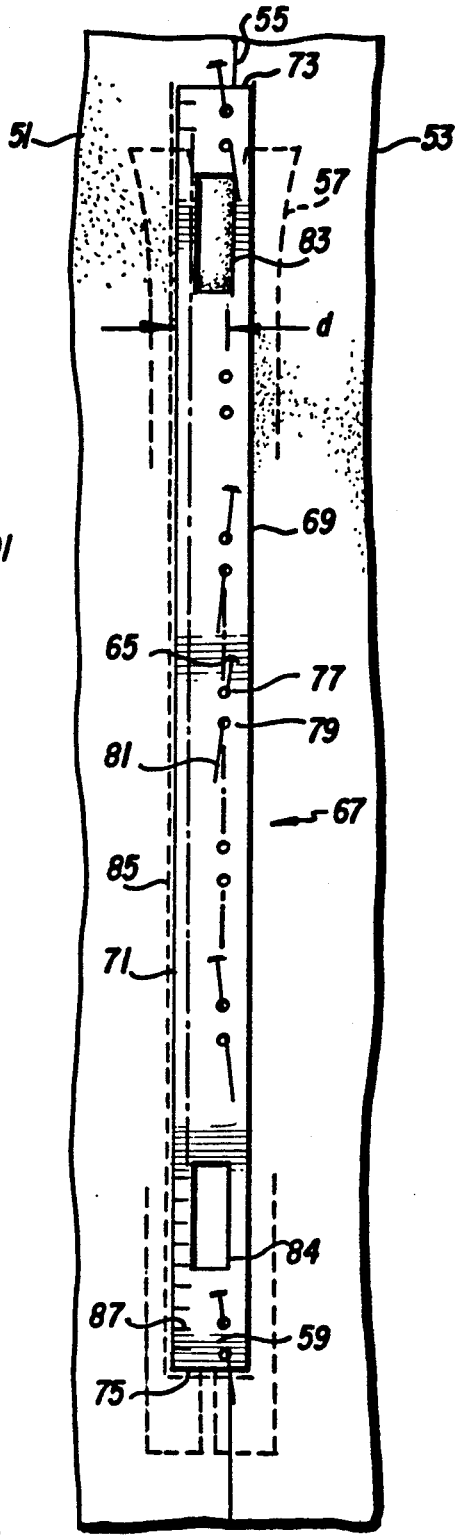
FIG. 2 is a plan view of a zipper guide for a lapped application with the guide in place on the material and the zipper.

Referring to FIG. 2, a zipper guide is shown which is to be used for a lapped application. Again, the material has been basted and prepared to the point wherein material 51 and 53 are shown with seam 55 and the dashed lines 57 partially disclose the zipper in position on the other side of the material.

Zipper guide 67, which is also shown as having parallel sides 69 and 71, upper edge 73, and bottom edge 75, is secured to the material by pins 81 through a plurality of perforated slots such as slots 77, 79. In this application, the perforations are in line along a longitudinal line which is offset from the center line of the zipper; but when guide 67 is placed, the perforations are in line with seam 55 of the material. Again, slot 83 is provided so that the slider and tab of the zipper (not shown) may be accommodated. In this particular guide, there is also shown slot 84 so that the guide could be inverted and used with either end. It is to be understood that guide 27 of FIG. 1 could also have a slot at the other end of the guide so that it could be used from either end of the guide. After the zipper is in place, stitching is begun beginning at the bottom of the zipper and across bottom edge 75 and upwardly along edge 71. When the stitching is completed, the zipper guide is removed and the basted seam is opened to provide the finished garment.

Again, it is desirable that the zipper guide be transparent and tinted and also include measurement indicia 87.

It will be understood that two stitching guides may be provided, as shown in FIGS. 1 and 2; however, if the flexible material which is used to make the stitching guide, such as a plastic, is of a sufficient thickness, both perforations could be used on the same guide. A proper thickness is required so that the guide would not be weakened to the point where it is likely to tear.

Figure 3:
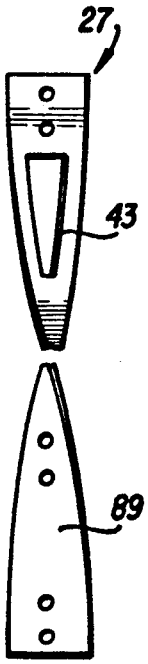
FIG. 3 is a partial view of the zipper guide of FIG. 1 showing the back side thereof.

FIG. 3 discloses one end of stitching guide 27 twisted so as to disclose the back side, which has applied thereto adhesive 89. Such an adhesive would assist in accurately placing the guide on the material. The adhesive could be applied directly to the back side or double-sided tape could be used on the back of the guide, in which case the tape could be replaced if need be.

Figure 4:
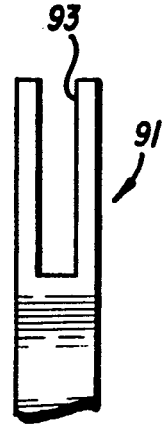
FIG. 4 is a partial sectional view of a modification of the zipper guide of FIG. 1.

FIG. 4 discloses a modification of either one of the guides shown in FIGS. 1 and 2 wherein slot 93 extends to the end of the strip. While this performs satisfactorily for the functional purpose of the guide, the crosspiece shown in FIGS. 1 and 2 is preferable so as to maintain a more stable structural guide for stitching purposes.

As an example of the stitching guide used, the standard seam allowance set for all patterns is $\frac{5}{8}$ inch. The width d of the guide of the present invention at least as to the centered application shown in FIG. 1 is preferably $\frac{5}{8}$ inch. In the case of the lapped application of FIG. 2, the critical distance d′ is between straight edge 71 and the alignment of perforations 77, 79. Again, the distance must be such that the dimensions of the guide allow the stitching to pass through the zipper material. Such a distance is preferably substantially $\frac{3}{8}$ inch. In the application shown in FIG. 2, the opposite edge from the stitching is not critical for alignment purposes.

As will now be evident, the present invention provides a device which greatly simplifies the application of a zipper to the material. It is to be understood that the above description and drawings are illustrative only and that the invention is to be limited only by the scope of the following claims.

I claim:

1. A stitching guide for attachment of a zipper to a base material comprising a flexible strip of elongated material having at least one sustantially straight longitudinal edge;

a plurality of in-line perforations in said strip extending along a longitudinal line substantially parallel to said one substantially straight longitudinal edge adapted for pin insertion; and at least one slot in said strip, said slot having a geometrical configuration adapted to circumscribe a slide on a zipper.

2. The stitching guide of claim 1 wherein one end of said strip has an edge substantially perpendicular to said one substantially straight longitudinal edge.

3. The stitching guide of claim 1 wherein said sets of in-line perforations are substantially along the longitudinal centerline of said flexible strip.

4. The stitching guide of claim 1 wherein said sets of in-line perforations lie substantially along a line parallel to but offset from the longitudinal centerline of said flexible strip.

5. The stitching guide of claim 1 wherein said strip is substantially rectangular.

6. The stitching guide of claim 1 wherein said slot extends from one end of said strip.

7. The stitching guide of claim 1 wherein said flexible material is transparent.

8. The stitching guide of claim 7 wherein said flexible strip is tinted.

9. The stitching guide of claim 1 further comprising measuring indicia along said substantially straight longitudinal edge.

10. The stitching guide of claim 1 further comprising two of said slots, said slots being located at opposite ends of said strip.

11. The stitching guide of claim 1 further comprising an adhesive on one side of said strip.

12. The stitching guide of claim 3 wherein the width of said flexible strip is substantially $\frac{5}{8}$ inch.

13. The stitching guide of claim 4 wherein the distance d′ between said straight longitudinal edge and said longitudinal line through said perforations is substantially $\frac{3}{8}$ inch.

* * * * *